United States Patent [19]

Paffhausen et al.

[11] Patent Number: 4,884,908

[45] Date of Patent: Dec. 5, 1989

[54] OVERLAPPINGLY OVERSTRIKEABLE RIBBON AND USE THEREOF IN CONTINUOUSLY FULL CASSETTES

[75] Inventors: Hans Paffhausen, Franklin, Tenn.; Ian Hogarth, Turriff; Andrew Scott, Turriff; Christine Mackintosh, Turriff, all of Scotland

[73] Assignee: Caribonum Ltd., Scotland, Scotland

[21] Appl. No.: 226,563

[22] Filed: Jul. 29, 1988

Related U.S. Application Data

[63] Continuation-in-part of Ser. No. 103,527, Sep. 30, 1987, abandoned.

[30] Foreign Application Priority Data

Oct. 15, 1986 [DE] Fed. Rep. of Germany ..... 3635114

[51] Int. Cl.[4] ..... B41J 31/00

[52] U.S. Cl. ..... 400/241.2; 428/207; 428/321.5

[58] Field of Search ..... 400/241.1, 241, 241.2; 428/207, 321.3, 321.5, 913, 914

[56] References Cited

U.S. PATENT DOCUMENTS

| | | | |
|---|---|---|---|
| 4,251,276 | 2/1981 | Ferree, Jr. et al. | 400/241 X |
| 4,268,368 | 5/1981 | Aviram et al. | 400/241.1 X |
| 4,310,258 | 1/1982 | Scott | 400/241.1 |
| 4,515,489 | 5/1985 | Kohle et al. | 400/241.2 |
| 4,544,292 | 10/1985 | Kohle et al. | 400/241.2 |
| 4,592,945 | 6/1986 | Mecke et al. | 400/241.1 X |
| 4,652,486 | 3/1987 | Tasaka et al. | 400/241.2 X |
| 4,675,063 | 6/1987 | Mecke et al. | 400/241.1 X |

FOREIGN PATENT DOCUMENTS

| | | | |
|---|---|---|---|
| 0117895 | 3/1983 | European Pat. Off. . | |
| 155640 | 9/1985 | European Pat. Off. | 400/241 |
| 0168045 | 1/1986 | European Pat. Off. . | |
| 208000 | 1/1987 | European Pat. Off. | 400/241 |
| 3307432 | 9/1978 | Fed. Rep. of Germany . | |
| 2913980 | 4/1979 | Fed. Rep. of Germany . | |
| 3214305 | 6/1981 | Fed. Rep. of Germany . | |
| 140110 | 12/1978 | Japan | 400/241 |
| 54130218 | 1/1986 | Japan . | |

OTHER PUBLICATIONS

IBM Tech. Disc. Bulletin, "Lophine Dyes for Printing", Twieg, vol. 26, No. 6, Nov. 1983, p. 2915.

*Primary Examiner*—William Pieprz
*Assistant Examiner*—James R. McDaniel
*Attorney, Agent, or Firm*—Herbert Dubno

[57] ABSTRACT

An overlappingly overstrikeable ribbon is described having a carrier film (2) and an ink-releasing coating (3) in the form of a plastic matrix applied thereto, which contains at least one fatty dye and/or oil-soluble dye and optional carbon black and/or other ink pigments, as well as further conventional additives. According to FIG. 1 the ink-releasing coating (3) can be subdivided into differently colored coatings (4a, 4b and 4c) representing the three primary colors and a black coating (4d) for producing color prints. The ink-releasing coating contains no fillers and contains a polyethoxylated fatty acid ester of a polyhydric alcohol as a solvent for the dye(s). This ribbon has advantages when used in continuously full cassettes which are more particularly used in matrix printing systems.

8 Claims, 1 Drawing Sheet

OVERLAPPINGLY OVERSTRIKEABLE RIBBON AND USE THEREOF IN CONTINUOUSLY FULL CASSETTES

This is a continuation-in-part of co-pending application Ser. No. 103,527 filed on Sept. 30, 1987, now abandoned.

FIELD OF THE INVENTION

The invention relates to an overlappingly overstrikeable ink ribbon with a carrier film and an ink-releasing coating in the form of a plastic matrix applied thereto, which contains at least one oil-soluble dye and/or one fatty dye and optionally carbon black and/or other ink pigments, as well as further conventional additives, and the use thereof in continously full cassettes.

BACKGROUND OF THE INVENTION

"Overlappingly overstrikeable ribbons", which are particularly intended for type wheel printers are known. The term "overlappingly overstrikeable" means that the ribbon transfer per strike which is normally somewhat more than one character width is reduced to a fraction of the character width, e.g. to ⅓ or 1/5, so that each strike only impinges on a fresh area of the ribbon with a small surface proportion, whereas the larger surface proportion of the character strike is on a ribbon area which was struck once or several times before. Such typewriter ribbons are also called "overstrike" ribbons. Such a ribbon, like a single-pass ribbon, only is moved in one direction, but is still utilized several times. Compared with repeatedly overstrikeable ribbons which have to be correspondingly moved forwards and backwards (with a full displacement of approximately one character width per strike), this procedure obviates the complicated and troublesome reversing mechanism required for changing the ribbon running direction.

In order to obtain high overstrike figures, it has hitherto been considered necessary to incorporate into the ink-releasing coating of an overlappingly overstrikeable ribbon fillers, particularly with large inner surface and a small particle size distribution of e.g. 0.2 to 20 micrometers. The fillers fulfill a number of functions and in particular serve to increase to productivity of the ribbon. It was also hitherto considered necessary to integrate the oil-based ink paste into a plastic matrix.

These requirements applied regardless of whether the particular overlappingly overstrikeable ribbon for the printing process was used with a type wheel printer, as a winding spool or as a continuously full cassette. Only as a result of this special construction, i.e. plastic matrix with filler, together with the coloring constituents and the oil, was it considered possible to permanently increase the ink supply for the printing process and thereby obtain the desired overstrike values. Reference is made to German Pat. Nos. 32 14 305 and 33 07 432 relative to the above prior art.

It could be asumed that excessively thick ink coatings would not be able to ensure a constant ink supply. Since a ribbon of this type wound up into a reel would be expected to have an "oiling out" tendency, i.e. there would be wetting of the engaging back of the winding. This wetting could lead to a sticking of the winding spool and to transfer problems in the cassette. This sticking could also occur if the ambient temperature rose greatly e.g. in excessively heated rooms.

OBJECT OF THE INVENTION

The object of the present invention is therefore to propose an overlappingly overstrikeable ribbon which, in contrast with the prior art, does not necessarily require the incorporation of fillers into the ink paste of the ink-releasing coating of a ribbon and which should have the same overlappingly overstrikeable properties but with production and machine function advantages.

DESCRIPTION OF THE INVENTION

According to the invention these objects are solved in that the ink-releasing coating excludes fillers and contains a polyethoxylated fatty acid ester of a polyhydric alcohol as the solvent of the dye component.

For the purpose of forming the plastic matrix of the ink ribbon according to the invention, it is possible to use the plastic binders conventionally used for such ribbons, such as polyacrylates, vinylchloride acetate copolymers, linear polyesters, polyvinylacetate, polystyrene and polyamide. The inventively essential solvent of the fatty dye in the form of a polyethoxylated fatty acid ester of a polyhydric alcohol is sufficiently incompatible with these binders to form a type of sponge layer on the ribbons. Certain polymeric materials are of particular advantage, e.g. cellulose-acetate-butyrate or -propionate (e.g. CAB 0.4 sec and MW of Eastman Chem.) The effects are further improved, if in addition to the cellulose derivative materials poly (lower alkyl) methacrylate or - acrylate materials are used, e.g. polymethylmethacrylate (e.g. Elvacite of Du Pont).

For the purposes of the invention, particular suitability has been revealed in the case of those polyethoxylated fatty acid esters which are derived from fatty acids with approximately 12 to 25 carbon atoms and from alcohols with approximately 3 to 6 hydroxy groups and which contain approximately 4 to 60 ethoxy groups per molecule. Particularly preferred examples are polyoxyethylene (40)-sorbitan pentaoleate to octaoleate, polyoxyethylene-glycerol triricinolate and the corresponding compounds of other fatty acids with on average approximately 40 ethoxy groups per molecule.

As a result of the higher solvency of the aforementioned specific polyethoxylated fatty acid esters for fatty dyes compared with conventional solvents, there is no need for the entire oil base of the ink-releasing coating of the ribbon to comprise said fatty acid esters. In fact they can readily be extended with up to 50% of the oils conventionally used hitherto for overstrike ribbons, including mineral oils, without resulting into an inadequate dye concentration of the ink paste.

It can also be appropriate to add cationic wetting agents to the ink-releasing coating, because they prevent an excessively intense wetting of the inner surfaces of the sponge structure of the plastic matrix with the normally acid colouring agent particles and therefore aid the mobility thereof. Preferably the wetting agents are constituted by fatty amine salts, i.e. salts of long-chain alkyl amines or diamines obtained from natural or synthetic fatty acids, particularly with long-chain or short-chain fatty acids.

The overlappingly overstrikeable ribbons according to the invention can also have juxtaposed or successively arranged, differing ink-releasing coatings, instead of a single colour range, in order to permit multicolour printing. In order to provide high fidelity multicolour prints, it is therefore appropriate to choose the three primary colours yellow, blue-green and purple-red. Particularly in the case of a matrix or needle printing system (dot matrix printing head), this can lead to color pictures, which are very similar to a color original, reproduced on a copy sheet or film through producing images corresponding to the particular color signals produced by color separation of the original with separation filters, i.e. blue, green and red three-color filters. According to the invention the different color-releasing coatings are formed by applying the differently colored ink pastes, which in each case contain dyes and optionally ink pigments with a yellow, purple-red or blue-green color and a solvent to be evaporated, apart from the binder and further appropriate additives.

All oil-soluble dyes, such as e.g. Sudan deep black (C.I. 26150) or fat-soluble black HB (C.I. 26150) are suitable as oil-soluble or fatty dyes. It is obviously possible to produce other colors of fluorescent characters by using corresponding oil-soluble dyes.

If use is made of a black fatty dye in order that the typing system gives black printing, it is appropriate for obtaining a better lightfastness of the black printing to incorporate carbon black into the ink-releasing coating, in addition to the fatty dye. If it is a differently colored oil-soluble dye or fatty dye, it is advantageously possible to use additionally ink pigments of the same color. Thus, advantageously the ribbon according to the invention contains both a fatty dye component and an ink pigment. Within the sense of the invention "dyes" in solvents and/or binders are understood to mean soluble coloring agents, as opposed to insoluble ink pigments (cf. Römpps Chemie-Lexikon, 8th edition, vol. 2, 1239 ff.). As a result mixtures of different dyes can be used, e.g. to reduce the tendency of fading and to improve the color tone or shade.

With regards to the proportions in which the constituents of the ink-releasing coating of the ribbon according to the invention are to be used, the following basic formulation (in parts by weight) has proved appropriate: approximately 10 to 25 parts by weight of polyethoxylated fatty acid ester with up to approximately 60 ethoxy groups, particularly approximately 20 to 60 ethoxy groups in the molecule, approximately 4 to 15 parts by weight of the dye component constituting an (approximately 30 to 60% solution in the polyethoxylated fatty acid ester with up to approximately 60 ethoxy groups in the molecule), approximately 16 to 50 parts by weight of binder and optionally approximately 6 to 25 parts by weight of carbon black and/or other ink pigments, and approximately 1 to 6 parts by weight of cationic wetting agent. These constituents are dispersed in a suitable solvent and this dispersion is applied to the carrier film in the manner to be described hereinafter. For the basic formulation use is made of approximately 45 to 90 parts by weight of solvent.

It is obviously possible to go above or below the indicated ranges of the basic formulation and this is a function of the requirements of the particular typing systems chosen. The most favorable values can be established by simple routine tests. In order to obtain the desired results importance is attached to the incorporation of the binder, which should not be in particle form and has originally completely dissolved and subsequently forms the plastic matrix. The binder also has a "corset function" or a support function.

The solvents used in producing the ribbon according to the invention are conventional solvents or solvent mixtures, such as methyl ethyl ketone, toluene and isopropyl alcohol. The "dry" ink paste obtained therewith (after evaporating the solvent in the form of e.g. toluene) is applied in a quantity of approximately 5 to 50 g per $m^2$ of carrier film and more especially 10 to 40 g per $m^2$ of carrier film. A minimum application quantity is approximately 5 to 15 g per $m^2$ of carrier film. The carrier film is made from conventional polymers, such as polyester, polyethylene, polypropylene or polyamide. The carrier film thickness is not decisive, but it is advantageously approximately 6 to 20 micrometers, especially approximately 15 micrometers, whilst it does not exceed approximately 40 micrometers. It can also be advantageous in certain cases to place an approximately 2 to 6 micrometer thick antistatic intermediate coating between the ink-releasing coating and the carrier film. Reference is made in this connection to DE-OS No. 28 15 344. This intermediate coating is simultaneously an adhesive agent between the carrier film and the ink-releasing coating.

The indicated ink paste, which preferably dissolves the fatty dye to saturation and partly contains it in suspended form in the case of supersaturation, is applied by conventional coating methods to the ribbon carrier film, e.g. with a doctor blade or roll coater. This is followed by drying. After drying the applied coating, the easily evaporatable solvent, e.g. toluene is either not present, or is only present in insignificant quantities in the finished product.

The advantages attainable with the inventive overlappingly overstrikeably ribbon appear more particularly if the ribbon is used in a continously full cassette, being located in the latter more or less loosely in loop form. Thus, unlike in the case of a winding spool, there is no longer any excessive pressure action between the contacting ribbon faces. Ribbons according to the invention housed in continously full cassettes have a particularly good productivity, if the ink paste is applied in a larger quantity. In the described systems, these larger quantities are not prejudicial and in particular do not lead to the aforementioned, disadvantageous "oiling out".

The advantages of the inventive ribbon become particularly apparent when used in matrix printing systems, for which it was hitherto considered necessary to use ribbons with cloth supports for obtaining satisfactory printing effects.

Compared with the conventional cloth typewriter ribbon, according to the invention a much lower ribbon feed speed can be set. Whereas a conventional cloth ribbon requires a certain regeneration time at overstrike, this is not the case with the ribbons according to the invention. The ink paste quantity applied can give an extremely high overstrike value. When the coloring substance of the color transfer agent is solely a dye component of one or more dyes, i.e. does not contain carbon black or another pigment then even a 300 times overstrike can be obtained. The additional presence of an ink pigment increases the lightfastness of the print, but reduces the overstrike value to approximately 200. However, the prior art discloses ribbons for matrix printing systems at best an approximately 40 times overstrike. It was hitherto believed that in the case of matrix printing systems having a ribbon with a carrier film, it was not possible to achieve the productivity of a corresponding cloth ribbon. This prejudice has been overcome by the present invention.

If the inventive ribbon is used on more recent matrix printing systems operating with a lower pressure action, even higher overstrike values than hitherto can be achieved. In the case of a matrix printing system, in conjunction with the desired overstrike value, it must be borne in mind that the basis for the consideration is the needle width. Thus, during an advance, e.g. with a 200 times overstrike, 1/200 of the needle width is covered, which means that the ribbon, without overstrike, would have to revolve 200 times, whereas in the case of overstrike a single revolution takes place. The single revolution leads to further important advantages in that the slower the ribbon is advanced, the better the needles can be retracted. Obviously the ribbon can also be moved rapidly, so that it can be used on conventional typewriters of the corresponding system. Thus, this also covers the possibility of use in matrix printing systems originally designed for cloth typewriter ribbons. In the case of the invention, the overstrike system also leads to reduced mechanical effort in the typewriter and to a more uniform utilization of the ribbon with a better and more uniform character pattern. The intensity gradient in the dot can no longer be perceived, which does not apply in old type wheel systems, where the basis is the width of the letter. Thus, it is possible by means of the invention in the case of a set slower ribbon transfer to obtain very high productivity levels, without the start being too black and the end too pale. In fact, the whole cassette types with a uniform, set average intensity.

The advantages of the inventive ribbon also become apparent when it is not understood to mean solely an elongated ribbon, but also a sheet or a blanket, the invention also extending to such cases.

BRIEF DESCRIPTION OF THE DRAWING

Advantageous developments of the invention can be gathered from the accompanying drawing, in which.

SPECIFIC DESCRIPTION

Figure 1:
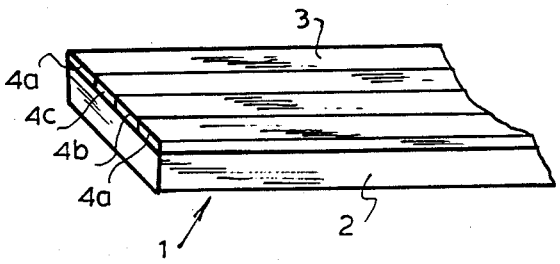
FIG. 1 is a multicolor ribbon according to the invention.

FIG. 1 shows the ink ribbon 1 with a carrier film 2 having an ink-releasing coating 3, which is subdivided into different colour coatings *4a*, *4b*, *4c* and *4d*. Color coatings *4a*, *4b* and *4c* represent the three primary colors yellow, purple-red and blue-green necessary for high fidelity color printing while coating *4d* is black and is used for normal typing.

Figure 2:
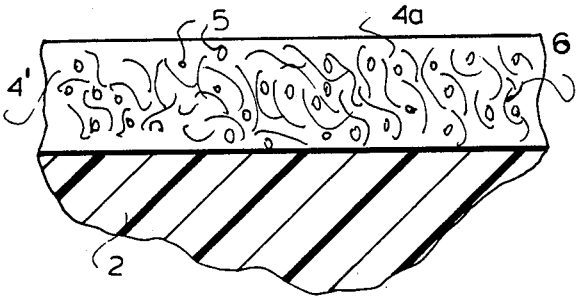
FIG. 2 is a larger scale detail of the ribbon.

FIG. 2 shows a detail of color coating *4a*. The latter comprises a plastic matrix 6, which contains a homogeneous ink paste 4' and incorporated carbon black particles 5 and is applied to the carrier film 2. The ink paste 4' contains the oil-soluble, black fatty dye, e.g. Sudan deep black (CI 26150), dissolved in polyoxyethylene-sorbitan septaoleate with approximately 40 ethoxy groups per molecule.

SPECIFIC EXAMPLES

The following examples illustrate the invention, the abbreviation PSSO standing in each case for polyoxyethylene-sorbitan septaoleate with on average 40 ethoxy groups per molecule.

| | Parts by weight |
|---|---|
| EXAMPLE I | |
| PSSO | 18.1 |
| Fatty black (C.I. 26150), 30% in PSSO | 9.6 |
| Tallow oil diaminooleate | 2.3 |
| Blue Pigment (C.I. 42765-1) | 2.1 |
| Carbon black | 7.0 |
| PVC/AC *(25% in methyl ethyl ketone) | 67.0 |
| Methyl ethyl ketone | 15.0 |
| Toluene | 21.6 |
| EXAMPLE 2 | |
| Glycerol trioleate | 14.1 |
| Fatty black (C.I. 26150) (30% in PSSO) | 10.0 |
| Tallow oil diaminooleate | 2.3 |
| Blue Pigment (C.I. 42765-1) | 2.1 |
| Carbon black | 7.0 |
| PVC/AC (25% in methyl ethyl ketone) | 67.0 |
| Toluene | 21.6 |
| Methyl ethyl ketone | 15.0 |
| EXAMPLE 3 | |
| Sorbitan dioleate | 18.1 |
| Sudan deep black (C.I. 26150) (30% in PSSO) | 10.0 |
| Coconut oil aminooleate | 3.2 |
| Blue Pigment (C.I. 42765-1) | 2.1 |
| Carbon black | 7.0 |
| PVC/AC (25% in methyl ethyl ketone) | 80.0 |
| Toluene | 21.6 |
| Methyl ethyl ketone | 15.0 |
| EXAMPLE 4 | |
| PSSO | 14.1 |
| Glycerol trioleate | 4.0 |
| Sudan Deep Black (C.I. 26150) (30% in PSSO) | 10.0 |
| Stearyl aminoacetate | 3.7 |
| Blue Pigment (C.I. 42765-1) | 2.5 |
| Carbon black | 7.0 |
| PVC/AC (25% in methyl ethyl ketone) | 72.0 |
| Toluene | 21.6 |
| Methyl ethyl ketone | 15.0 |
| EXAMPLE 5 | |
| PSSO | 22.4 |
| Mineral oil | 8.4 |
| Tallow oil diaminooleate | 3.4 |
| Carbon black | 12.3 |
| PVC/AC (25% in methyl ethyl ketone) | 120.0 |
| Fatty Black (C.I. 26150) (30% in PSSO) | 11.9 |
| Toluene | 21.6 |
| Methyl ethyl ketone | 15.0 |
| EXAMPLE 6 | |
| Mineral oil | 9.62 |
| Tallow oil diaminooleate | 1.71 |
| Carbon black | 6.20 |
| PVC/AC (25% in methyl ethyl ketone) | 36.20 |
| Neopen Blue 808 (C.I. 74400) (30% in PSSO) | 10.50 |
| Neopen Red 336 (C.I. 12716) (30% in PSSO) | 3.45 |
| Sudan Yellow 146 (C.I. 12700) (30% in PSSO) | 3.45 |
| Kieselguhr | 17.81 |
| Toluene | 11.10 |
| Methyl ethyl ketone | 13.50 |
| EXAMPLE 7 | |
| Glycerol trioleate | 9.60 |
| Tallow oil diaminooleate | 1.71 |
| Carbon black | 5.30 |
| Blue Pigment (C.I. 42765-1) | 1.40 |
| PVC/AC (25% in methyl ethyl ketone) | 36.60 |
| Black Dye (Solvent Black 47) (30% in PSSO) | 8.65 |
| Blue Dye (C.I. 74400) (30% in PSSO) | 8.65 |
| Kieselguhr | 17.80 |
| Toluene | 11.10 |
| Methyl ethyl ketone | 13.50 |
| EXAMPLE 8 | |
| Mineral oil | 5.73 |
| Tallow oil diaminooleate | 2.94 |
| Blue Pigment (C.I. 74160) | 2.87 |
| PVC/AC (25% in methyl ethyl ketone) | 53.90 |
| Fatty Blue (C.I. 61554) (30% in PSSO) | 15.29 |
| Kieselguhr | 3.79 |
| Toluene | 15.48 |
| EXAMPLE 9 | |
| Glycerol trioleate | 3.90 |
| Mineral oil | 3.90 |
| Yellow Pigment (C.I. 21100) | 3.45 |
| Tallow oil diaminooleate | 1.71 |
| Cellulose acetate butyrate resin (25% in methyl ethyl ketone) | 33.72 |

-continued

| | Parts by weight |
|---|---|
| Methyl methacrylate resin (25% in methyl ethyl ketone) | 33.75 |
| Toluene | 19.60 |

*Vinylchloride/acetate copolymer

Note to the preceding examples 6 to 9:

"Neopen" is the trade name for a BASF range of solvent dyes. These examples include combinations of dyestuffs.

We claim:

1. An impact-transfer overlappingly overstrike ribbon capable of hundreds of overlapping strikes in single-pass use, said ribbon comprising:

a carrier film forming a support; and a filler-free color-releasing layer on said support, said filler-free color-releasing layer consisting essentially of:

a dye component consisting of at least one fatty dye and/or one oil-soluble dye, polyethoxylated fatty acid ester with approximately 12 to 25 C-atoms and alcohols with 3 to 6 OH-groups which contain approximately 4 to 60 ethoxy groups in the molecule, a plastic matrix in which the dye component solubilized in the polyethoxylated fatty acid ester containing 4 to 60 oxyethylene groups per molecule is dispersed, and optionally carbon black or another pigment of a color compatible with that of the color of said color-releasing layer.

2. The ribbon defined in claim 1 wherein said polyethoxylated fatty acid ester is a polyethoxylated sorbitan fatty acid ester.

3. The ribbon defined in claim 2 wherein said polyethoxylated sorbitan fatty acid ester is a polyoxyethylene-(40)-sorbitan-pentaoleate to octaoleate.

4. The ribbon defined in claim 1 wherein said polyethoxylated fatty acid ester is extended by up to 50% of natural or synthetic oils.

5. The ribbon defined in claim 3 wherein said color-releasing coating contains a cationic wetting agent.

6. The ribbon defined in claim 1 which comprises on said support a plurality of different-color ones of said color-releasing coating in respective strips on said support for multicolor printing.

7. The ribbon defined in claim 6 wherein four of said strips are provided, one of said strips being yellow, another of said strips being blue-green, a third of said strips being purple-red and a fourth of said strips being black.

8. A method of reproduction which comprises the steps of:

(a) forming an impact-transfer overlappingly overstrike ribbon capable of hundreds of overlapping strikes in single-pass use, said ribbon comprising:

a carrier film forming a support, and a filler-free color-releasing layer on said support, said filler-free color-releasing layer consisting essentially of:

a dye component consisting of at least one fatty dye and/or one oil-soluble dye, polyethoxylated fatty acid ester with approximately 12 to 25 C-atoms and alcohols with 3 to 6 OH-groups which contain approximately 4 to 60 ethoxy groups in the molecule, a plastic matrix in which the dye component solubilized in the polyethoxylated sorbitan fatty acid ester containing 4 to 60 oxyethylene groups per molecule is dispersed, and optionally carbon black or another pigment of a color compatible with that of the color of said color-releasing layer;

(b) stepping said ribbon in a continuously full cassette between a printing head and a print-receiving surface at an increment of width less than the width of a character to be printed by said head; and (c) impacting an image of said character with said head upon said ribbon.

* * * * *